United States Patent [19]

Trucksess

[11] Patent Number: 4,856,437

[45] **Date of Patent: * Aug. 15, 1989**

[54] SECURITY ENCLOSURE FOR TRANSACTION MACHINE

[76] Inventor: A. William Trucksess, 451 Creek Rd., R.D. #2, Moorestown, N.J. 08057

[ * ] Notice: The portion of the term of this patent subsequent to Sep. 29, 2004 has been disclaimed.

[21] Appl. No.: 57,251

[22] Filed: Jun. 2, 1987

Related U.S. Application Data

[63] Continuation-in-part of Ser. No. 724,461, Apr. 18, 1985, Pat. No. 4,696,239.

[51] Int. Cl.[4] ..... G07G 5/00

[52] U.S. Cl. ..... 109/24.1; 109/66; 221/281

[58] Field of Search ..... 109/2, 5, 10, 11, 19, 109/24.1, 66, 73; 221/281, 282

[56] References Cited

U.S. PATENT DOCUMENTS 4,399,755 8/1983 Wiedmann ..... 109/66
4,497,261 2/1985 Ferris et al. ..... 109/2
4,513,670 4/1985 Berman ..... 109/24.1
4,558,650 12/1985 Berman ..... 109/24.1

FOREIGN PATENT DOCUMENTS 0049533 4/1982 European Pat. Off. ..... 109/73

*Primary Examiner*—Neill R. Wilson
*Attorney, Agent, or Firm*—Morton C. Jacobs; William Freedman

[57] ABSTRACT

An automatic teller machine (ATM) is provided with apparatus for turning it betweeen its normal-operating position and its service-access position. Turning occurs about a vertical axis that is moved transversely of itself during turning so that the ATM can be used in an enclosure of minimum dimensions. The turning apparatus comprises: (a) a jackscrew mechanism mounted on a base and coupled to a carrier for the ATM and (b) two cam connections between the base and the carrier for controlling during turning the paths of the carrier and said vertical axis.

14 Claims, 12 Drawing Sheets

10
31
3
22
20
16
21
17
12
14
18
32
3
20

SECURITY ENCLOSURE FOR TRANSACTION MACHINE

CROSS-REFERENCE TO RELATED APPLICATION

This application is a continuation-in-part of application Ser. No. 724,461 - Trucksess, filed Apr. 18, 1985, entitled "Security Enclosure for Transaction Machine", now U.S. Pat. No. 4,696,239.

FIELD OF THE INVENTION

This invention relates to turning apparatus for a transaction processing machine, such as an automatic teller machine (ATM), that is housed within a security enclosure, and, more particularly, relates to turning apparatus capable of turning the machine from a normal operating position to a service-access position in such a manner that the desired turning can be accomplished within an enclosure of near-minimum width.

BACKGROUND OF THE INVENTION

In the past few years there has been a large increased use of the automatic teller machine (ATM), which functions to process automatically bank transactions under computer control. These machines are usually mounted in the outer walls of banks. They provide twenty-four hour service to bank customers by allowing customers to engage in transactions, such as the deposit or withdrawal of funds, without entry into the bank or the need for the services of bank tellers.

When the ATM is mounted in the outer walls of banks, customers have access from the sidewalk and the bank employees have access to the rear of the ATM from the interior of the bank for servicing and maintenance. A locked door in the rear of the machine provides access into the cash box for replacement of the cash that is withdrawn by customers. Bank employees, within the security area of the bank itself, handle large amounts of cash to replenish the machines.

The situation is quite different for ATM's located on islands outside the bank for automatic drive-through banking. The security requirements are much more severe with respect to ATM's mounted on exterior islands versus through-mounted ones in the walls of building. The enclosures must be made strong enough to make intrusion difficult; employees carrying large amounts of cash must have minimal outside exposure, and must get into the enclosure rapidly and must be secure while they are servicing or maintaining the machine.

Prior art enclosures for transaction machines are described in U.S. Pat. No. 4,417,527 to Williams and U.S. Pat. No. 4,121,523 and 4,348,966 to Hastings.

An additional problem arises because the islands initially built for drive-through teller banking are generally narrow in width (e.g., about 4 feet and often even as little as about 3 feet) and the enclosures which are mounted on them must be similarly compact. Additionally, minimizing the width of the islands reduces the outside land requirements for a given number of enclosures and their machines, or allows more enclosures and machines to be installed in a given area.

Accordingly, it is among the objects of this invention to provide a new and improved system for drive-through automatic tellering that is highly secure and economically minimizes enclosure dimension requirements.

Another object of this invention is to provide new and improved apparatus for turning an ATM in an enclosure for servicing and maintenance which minimizes the required enclosure width.

Another object is to provide, for turning an ATM within its enclosure and for attaining the object of the immediately-preceding paragraph, improved apparatus employing a jackscrew operating mechanism that is operable to cause the carrier for the ATM to rotate in such a way that the axis of rotation of the ATM moves with respect to both the carrier and the enclosure during turning of the ATM.

Another object is to provide a jackscrew operating mechanism capable of turning the ATM from its normal-operating position to its service-access position within an enclosure of near-minimum width and also capable of positioning the ATM during the final portion of such turning in a position where it effectively closes off the window in the enclosure that was occupied by the ATM when it was in its normal-operating position.

Another object is to provide a new and improved ATM turning apparatus in an enclosure that is highly secure during operation of the ATM by customers and during servicing and maintenance of the ATM by employees.

A further object is to provide a highly secure, minimum width enclosure with rapid entrance and egress and minimum outside exposure time to ATM servicing employees handling large amounts of cash.

Another object is to provide a highly secure, minimum-width enclosure with a powered automatic apparatus to rapidly turn the ATM to its servicing and maintenance position and back to its normal operating position.

SUMMARY OF THE INVENTION

In accordance with an embodiment of this invention, a compact enclosure is achieved by means of a special apparatus for turning a transaction processing device for service and maintenance. When the device is an automatic teller machine (ATM) used for drive-through banking, it is particularly constructed to be installed in a secure enclosure on an island adjacent to a bank.

The front of the ATM normally projects through a window in the wide wall of the enclosure which provides access to customers sitting in their vehicles or standing at the ATM. The machine is serviced by turning the ATM approximately at right angles about a generally vertical axis that is moved through a prescribed path during turning.

The path of movement of the axis is such that the ATM is able to project through the window during turning, while a rear corner of the ATM moves generally parallel to a rear wall of the enclosure during most of the turning motion of the ATM. This accommodates the diagonal dimension of the ATM in such a way that the width of the enclosure is less than the diagonal dimension of the ATM and but a small amount greater than the depth of the ATM to provide a small clearance at the rear wall of the enclosure.

In a particular embodiment of the invention, the means for mounting the ATM comprises a movable carrier for the ATM, a base, and means for supporting the carrier on the base for turning movement thereon. The turning means comprises a rotatable jackscrew mounted on the base, a traveling nut on the jackscrew that moves along the length of the jackscrew when the jackscrew is rotated, and coupling means between the traveling nut and the carrier for transmitting carrier-turning force from the nut to the carrier. This coupling means is constructed to allow the carrier to turn about the aforesaid vertical axis and also to allow this vertical axis to move with respect to both the enclosure and the carrier as the traveling nut is moved along the jackscrew.

The above and other objects of this invention, the various features thereof, as well as the invention itself, may be more fully understood from the following detailed description when read together with the accompanying drawing.

BRIEF DESCRIPTION OF THE DRAWING

FIG. 10 shows the parts in the positions occupied when the ATM is in its normal-operating position.

DETAILED DESCRIPTION OF THE INVENTION

Figure 1:
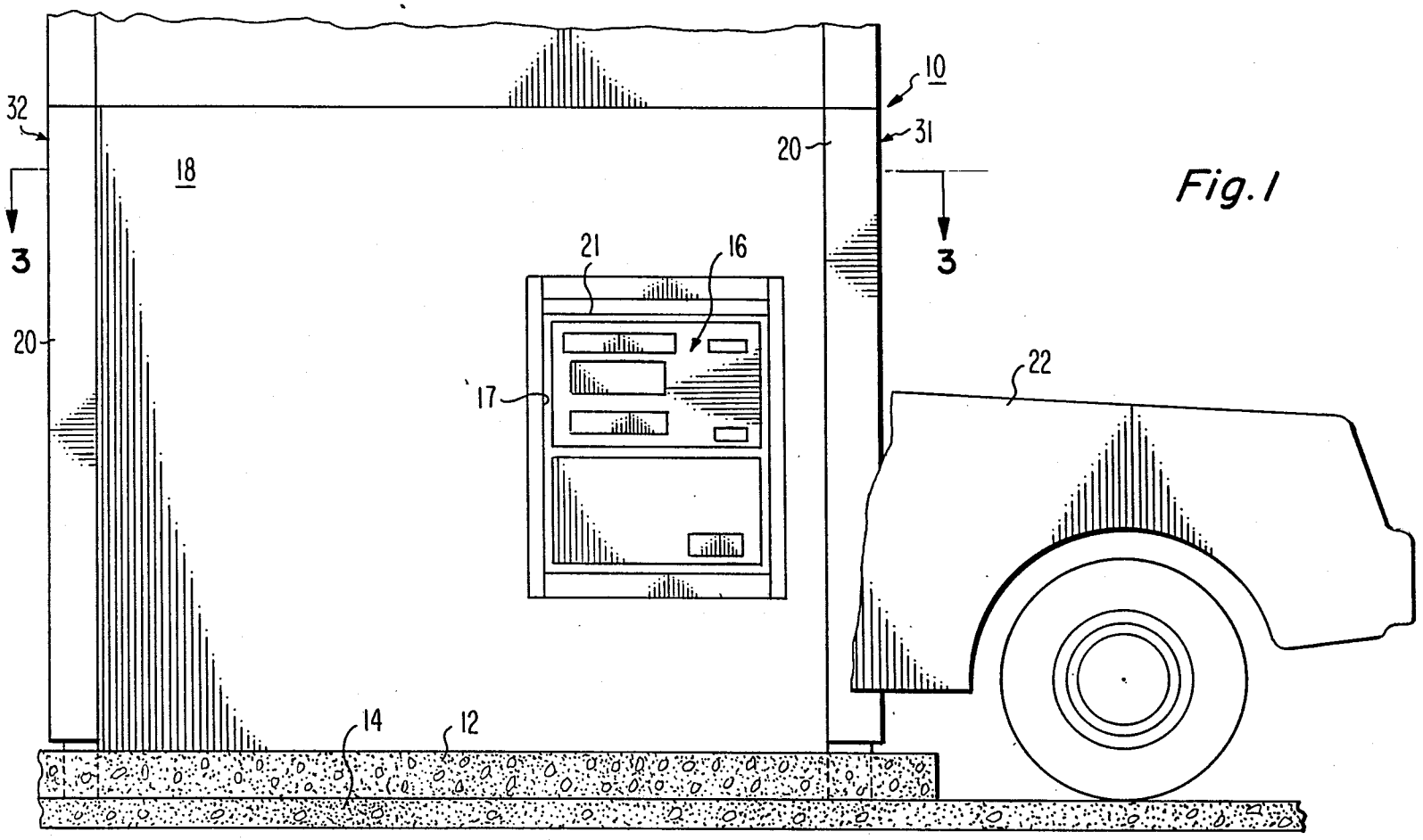
FIG. 1 is an elevation view of the operating side of an enclosure for drive-through banking, in which an ATM is installed and which embodies this invention.
Figure 2:
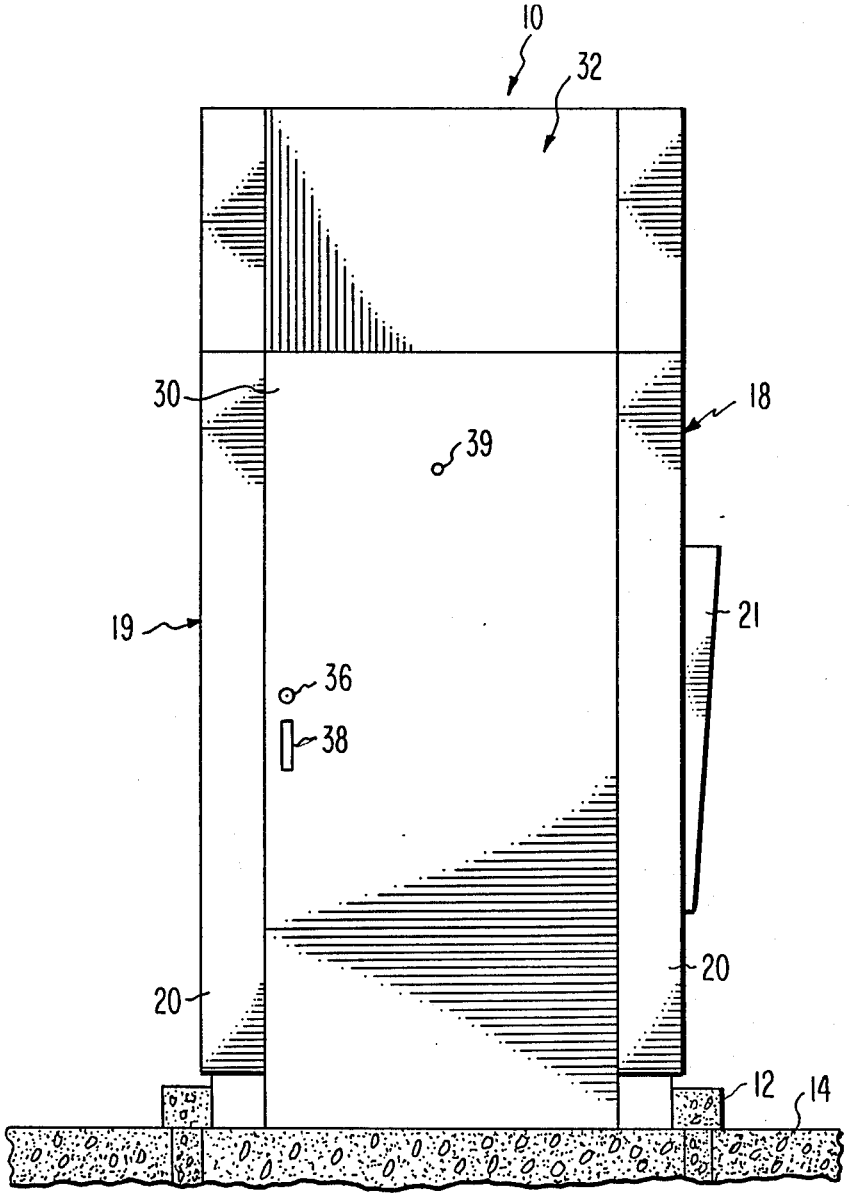
FIG. 2 is an elevation view of the access-door end of the enclosure of FIG. 1.

In the drawing, corresponding parts are referenced by similar numerals throughout.

In FIGS. 1–4, the rectangular enclosure 10 (in a highly secure construction for banking purposes) is emplaced on an island 12 which is set in concrete pavement 14. An ATM 16 is installed in the enclosure 10 and it projects through an access window 17 in front sidewall 18. Removable metal strips 20 cover the corners of the enclosure and are replaceable should they be dented or otherwise damaged during ATM use.

Drive-through banking ATM services are provided to a customer in an automobile 22 who can stop opposite the window 17, through which the operating interface 21 projects, and make transactions including deposits or withdrawals of cash without leaving the vehicle.

The rear of ATM 16 has a hinged door 24 (FIG. 3 and 4) that is opened to gain access to a secure cash box and the operating circuits and devices (not shown) of the ATM for servicing and maintenance. Since large amounts of cash must be periodically deposited into the ATM to replenish the cash box to cover withdrawals, a secure area 26 is provided within the enclosure 10 for the bank personnel servicing the machine. For compactness, the space between the ATM door 24 and back wall 19 (see FIG. 3 with the ATM in its normal operating condition) is made very small, thus too small to permit opening the door 24 for internal access while the ATM is in its normal position.

Security door 30 (FIG. 2) is installed in end wall 32 and attached by a concealed continuous hinge. Key slot 36 and handle 38 allow access to persons possessing the proper key. For added security, peep hole 39 may be used by persons within the enclosure to assure that the outer area is clear before opening the door or to permit access only to authorized persons deserving entry.

An ATM is a heavy piece of equipment weighing a ton or more and it is mounted on a special turning apparatus 40 (FIGS. 3–6) which includes a rectangular carrier 54 that holds the rectangular base of the ATM. A drive motor 42 when energized rotates and supplies power to turn ATM carrier 54 by means of a chain 45.

Figure 3:
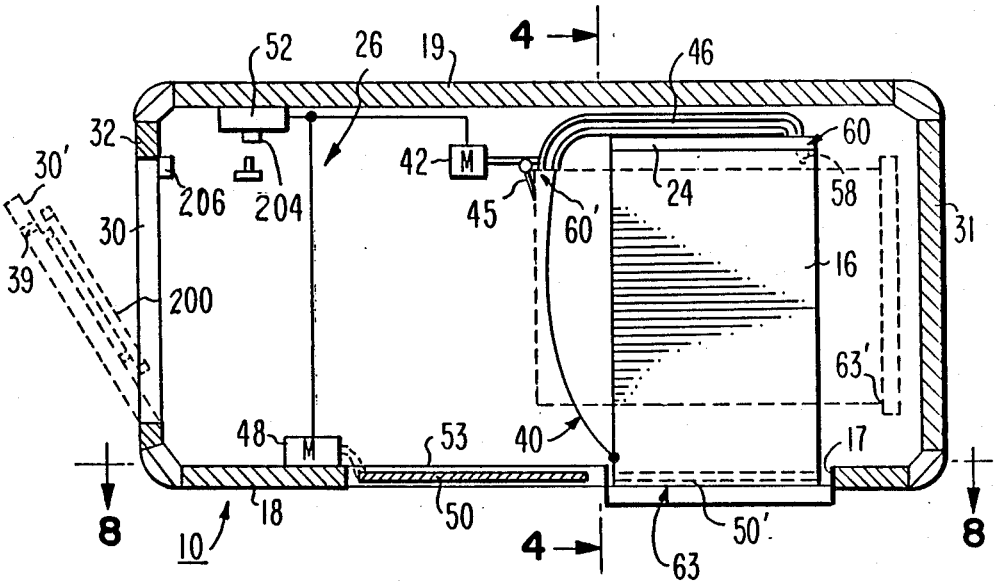
FIG. 3 is a top view of the interior of the enclosure taken along the line 3—3 of FIG. 2 and illustrating the ATM in operating position.

The rectangular periphery of ATM 16 in its normal operating position (i.e. when in use by bank customers) is shown (FIG. 3) in solid lines. When turning apparatus 40 has turned ATM carrier 54 about 90° or more the ATM is oriented for servicing and maintenance, as shown in FIG. 3 with the periphery of ATM 16 in broken lines. When ATM 16 reaches its servicing and maintenance position, a motor 48 rotates and supplies power to move shutter panel 50 (to the right along slide 53 to close access window 17. Closure panel 50 is shown with dashed lines in its closed service position and referenced as 50'.

When servicing or maintenance is complete, motor 48 is rotated in the reverse direction supplying power to move closure panel 50 back to its original position (to the left) to open window 17. Carrier drive motor 42 is then rotated in the reverse direction to turn ATM 16 back to its operating position, providing access to customers at ATM interface 21.

Figure 9:
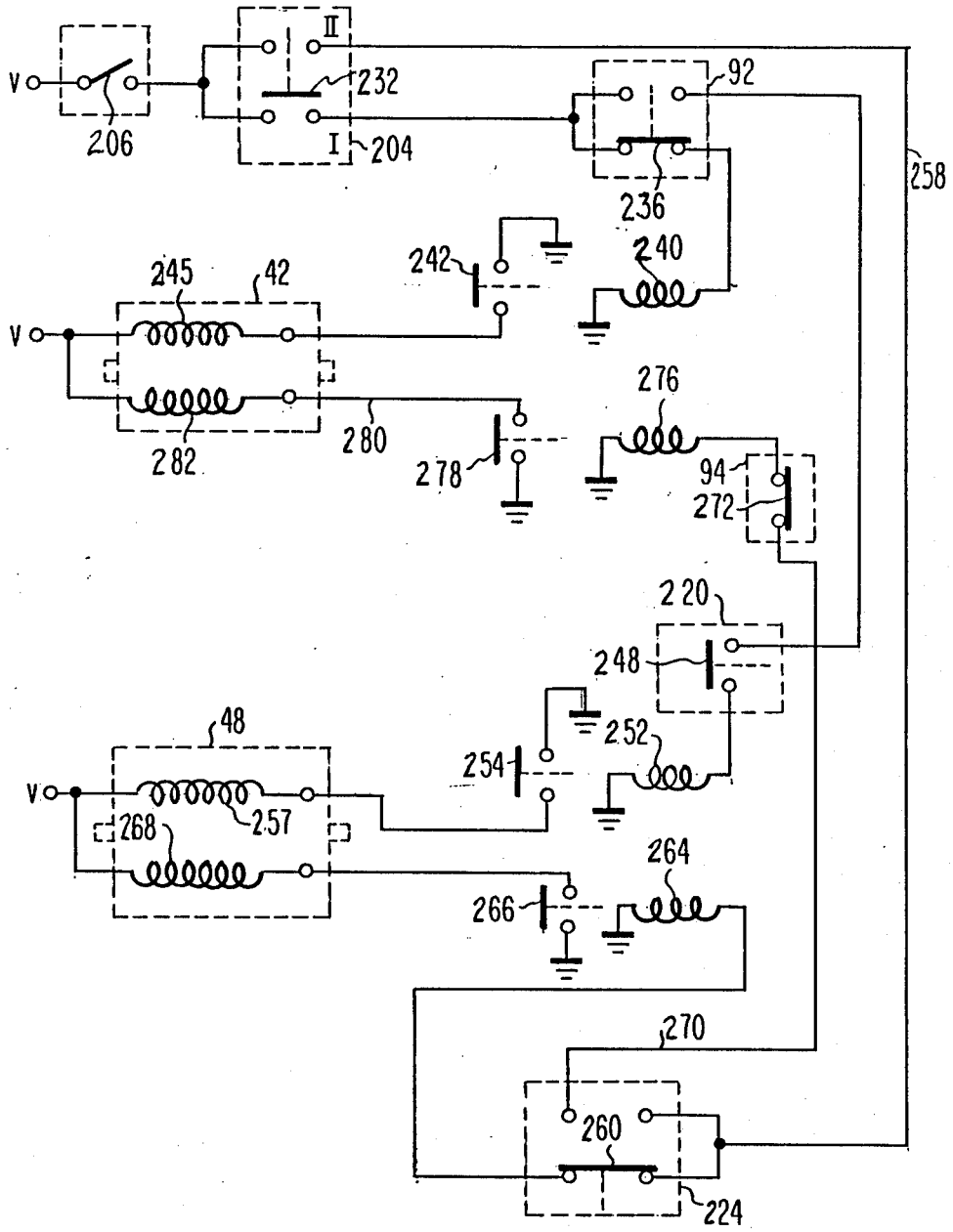
FIG. 9 is a circuit diagram of the control and drive system for operation of the turning and related apparatus of this invention.

The construction and operation of control box 52 which sequences the operations of motor 42 and 48 by means of limit switches is described in detail below with reference to FIG. 9.

The ATM carrier 54 of turning apparatus 40 has mounted on the underside thereof a bearing 58 which is positioned within, moves along and is guided by positional track 46 fixed to base assembly 68 when ATM 16 is being turned. Track 46 is fixed to base assembly 68.

During turning, ATM carrier 54 pivots about the axis of a pivot bearing 62. The latter pivot bearing is positioned within and is constrained by pivot track 64. Pivot bearing 62 rides along pivot track 64 when ATM carrier 54 is being turned.

Figure 5:
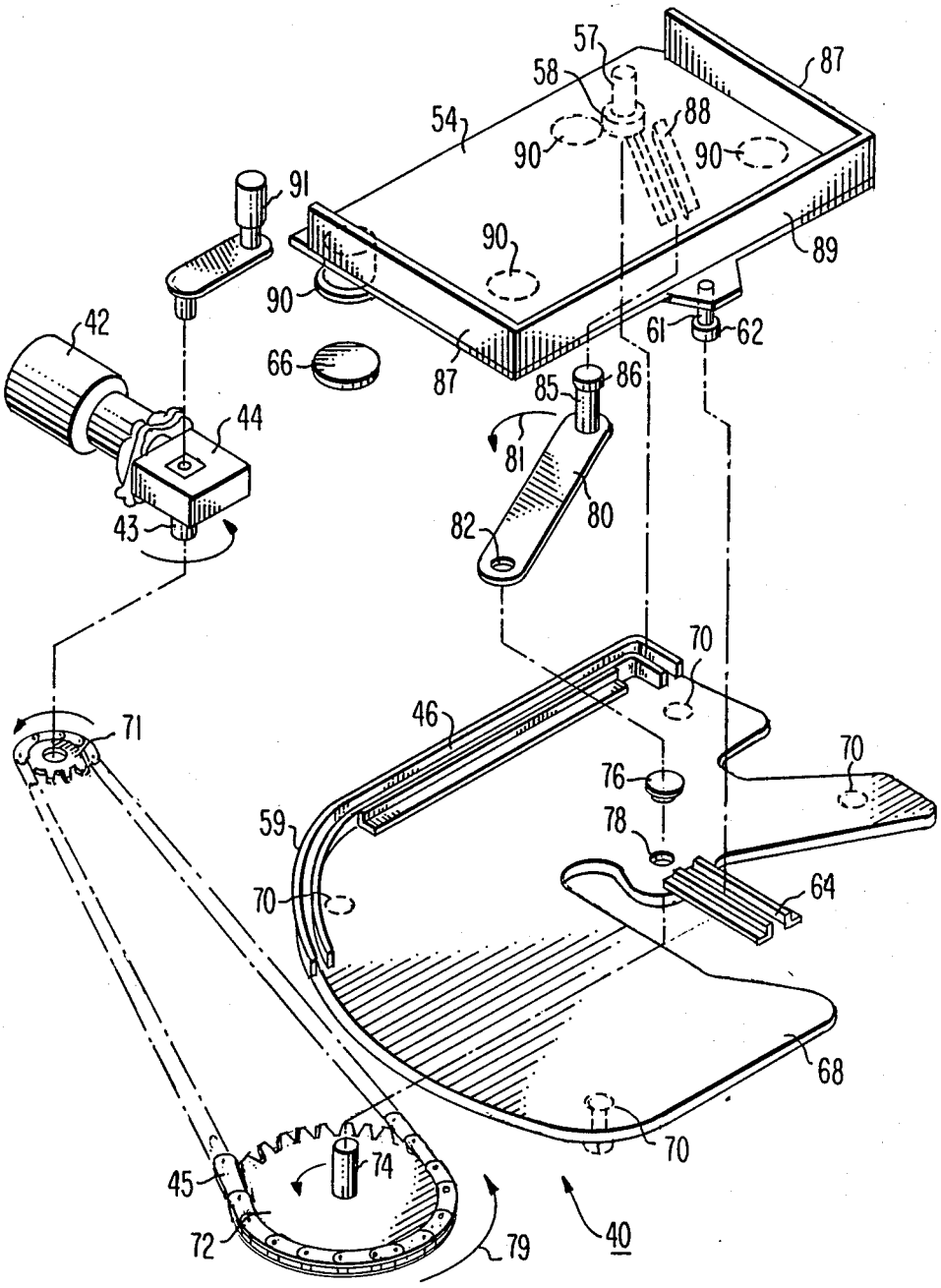
FIG. 5 is an exploded view of the various components of a turning apparatus for the ATM shown in FIG. 4.
Figure 6:
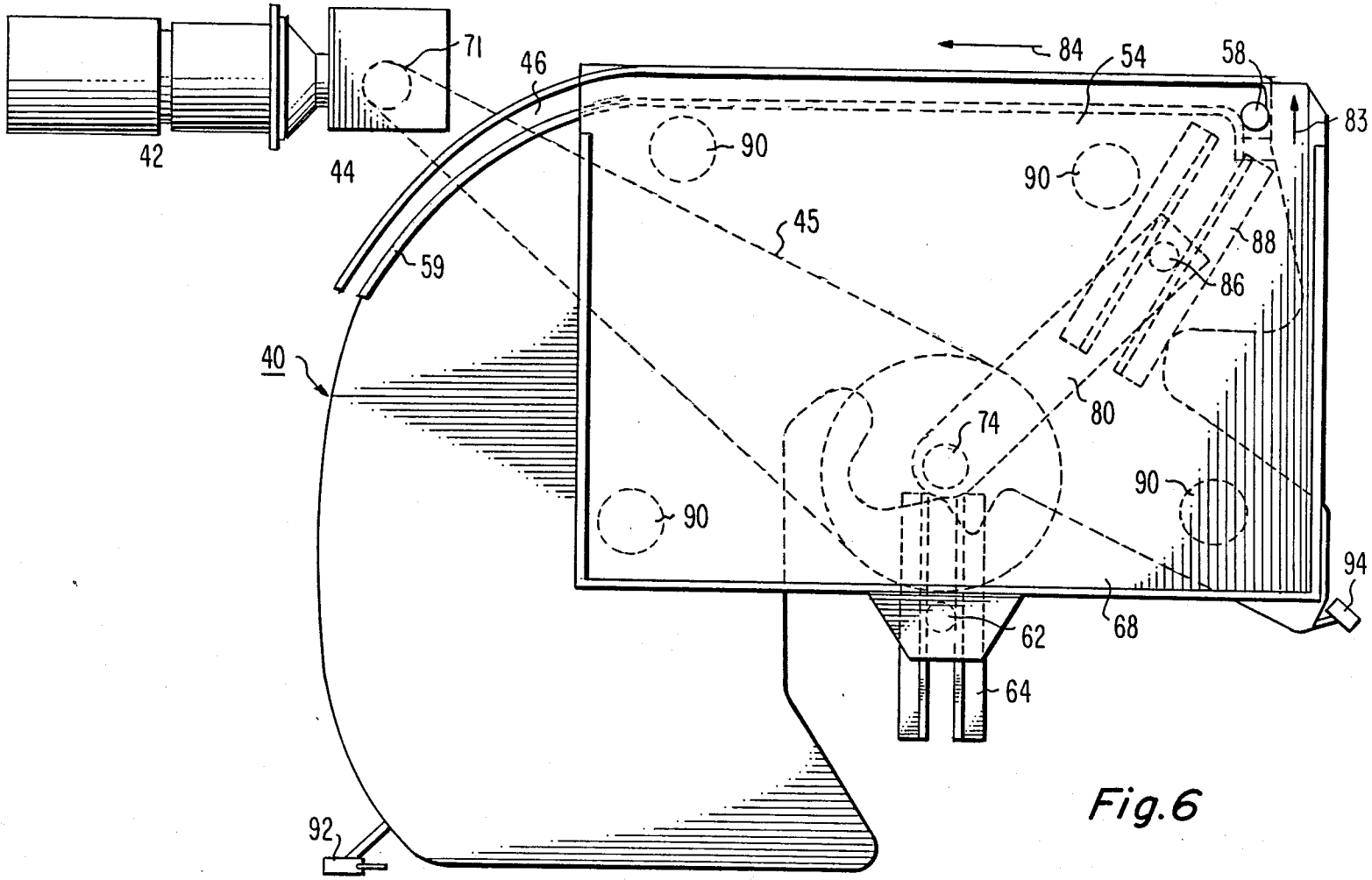
FIG. 6 is a top view of the turning apparatus of FIG. 5 in assembled condition.

Friction-reducing pads 66, preferably of Teflon, attached to legs on the underside of carrier 54 slide on the flat upper surface of base assembly 68 when ATM 16 is turned. "Teflon" is duPont's trademark for polytetrafluoroethylene. Turning apparatus 40 rests on leveling bolts 70 which are attached to the underside of base assembly 68 and sit on the floor of the enclosure. A variably-coupled drive between motor 42 and carrier 54 is shown in FIGS. 5 and 6.

Figure 4:
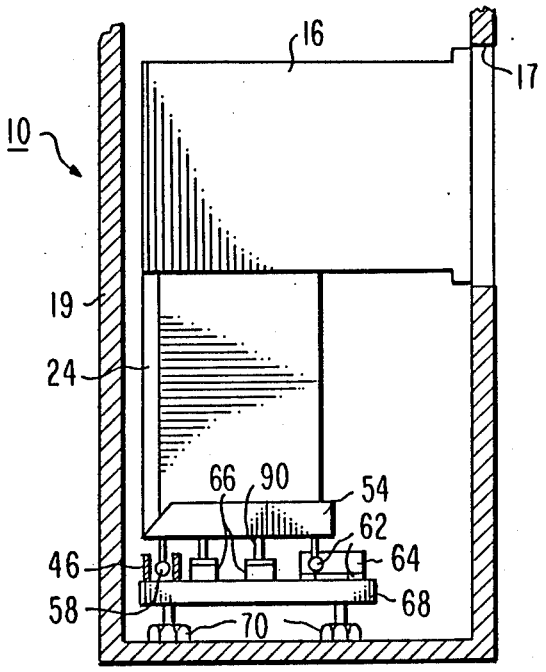
FIG. 4 is an elevation view of the interior of the enclosure taken along the line 4—4 of FIG. 3 and showing the side of the ATM moved back from operating position.

To control the turning path of the ATM carrier 54, the positional track 46 extends generally parallel to the rear wall of the rectangular enclosure 10. The bearing 58 at the right-rear corner 60 of the ATM and its carrier 54 is guided by that track 46 as the carrier is turned by the motor 42 around the pivot axis of pivot bearing 62 (FIGS. 3 and 4). The latter pivot at the center front of carrier 54 is free to slide along and within the pivot track 64. Thus, when the ATM carrier is driven from its normal operating position, track 46 constrains the guided bearing 58 at the carrier's and the ATM's right-rear corner 60. That constraint, in turn, guides that ATM corner 60 to move substantially parallel to the rear wall, ending up at the service position 60'. The left-front corner 63 of the ATM is free to turn about pivot bearing 62 and moves out through the open window 17 in the front wall 18 and back in to end up at position 63'. In this turning movement, the major dimension is the diagonal between these two corners 60 and 63 of the ATM. Since a substantial part of that diagonal (during this variable-axis turning) moves through window 17 and outside of the enclosure 10, the width of the enclosure can be made substantially less than the diagonal of the turning ATM. In contrast, in rotation about a fixed axis, the minimum width of the enclosure would ordinarily be this ATM diagonal.

The axis of pivot 62 varies in position as the pivot moves back and forth in its track 64. The positional track 46 determines the reciprocating movement of pivot bearing 62 in its track 64. At the ATM's normal operating position, the positional track 46 has a bend extending forward where its bearing 58 then rests. The drive motor 42 moves the ATM a short distance back out of its window with bearing 58 guided by track 46. Likewise, pivot track 64 permits pivot bearing 62 to move back. The latter pivot 62 moves forward and then back as guided bearing 58 traverses track 46. At the other end of positional track 46, a bend 59 in that track guides the bearing 58 to turn the ATM sharply into its final position for service and maintenance.

The drive motor 42 is connected to the ATM carrier 54 by a yieldable coupling to accommodate the variable-axis turning of the carrier. As described below, a drive bearing in a drive track is used for this coupling.

When the drive motor 42 for forward rotation is energized, shaft 43 from speed reducer 44 rotates in the direction shown by the arrow, turning sprocket wheel 71, chain 45 and sprocket wheel 72. Keyed shaft 74 on sprocket wheel 72 is positioned through bushing 76 in hole 78 in base assembly 68, and rotates in the forward direction as shown by arrow 79. One end of drive arm 80 is locked to shaft 74 through keyed hole 82, to be turned in a corresponding direction shown by the arrow 81. A drive bearing assembly is mounted on the other end of drive arm 80, and comprises drive bearing shaft 85 and drive bearing 86. When turning apparatus 40 is assembled, drive bearing 86 is positioned within drive track 88 mounted to the underside of carrier 54.

Hand crank 91 may be used to turn carrier 54 when motor 42 is inoperative or power to motor 42 is interrupted. Hand crank 91 is specially slotted and kept in the possession of authorized users only for security purposes.

Also mounted to the underside of carrier 54 is the carrier-guiding bearing 58 and bearing shaft 57 and the pivot bearing shaft 61 and pivot bearing 62, which are described above. The carrier 54 has upstanding sides 87, 89 on three sides within which the ATM sits. Pivot bearing 62 is located at about the middle of the front side 89.

Legs 90 extend from the underside of carrier 54 and Teflon pads 66 are attached to the ends of those legs 90. When turning apparatus 40 is assembled, Teflon pads 66 rest on and slide on the upper flat surface of base assembly 68 and slide to provide sliding and turning support as carrier 54 turns.

Legs 90 carry the weight of carrier 54 and ATM 16 when it is mounted on carrier 54 and Teflon pads 66 are in sliding contact with the upper surface of base assembly 68. This Teflon pad construction is effective in supporting the thousand-pound weight of the ATM in sliding movements over the base assembly 68 that may change rapidly as the ATM is turned from one position to another. The shape of base 68 is cut to remove metal not serving any function.

When assembled, carrier 54 (FIG. 6) is positioned so that the guide bearing 58, pivot bearing 62 and drive bearing 86 are placed within their respective tracks 46, 64, and 88. When shaft 43 extending from speed reducer 44 rotates in the direction shown (FIG. 5) bearing 86 applies a turning force, via track 88, to carrier 54. The latter begins to turn about pivot bearing shaft 61 in a path determined by positional track 46. That is, the right hand rear corner 60 of ATM 16 moves generally parallel to the rear wall 19 of the enclosure 10 (FIGS. 3 and 7).

The initial motion of carrier 54 from the normal position is to the rear as shown by arrow 83 (FIG. 6), which identifies the initial path of bearing 58. This moves ATM 16 back slightly so that the front of ATM 16 clears access window 17 in front sidewall 18 and can turn through that window. As the drive bearing 86 continues to exert turning force on track 88, bearing 58 moves along positional track 46 in a path shown by arrow 84. Bearing 58 travels parallel to rear enclosure wall 19 along most of track 46 and turns with the track to complete the turning of the ATM through 90° or more as desired. When the servicing and maintenance position of the ATM is reached, the carrier 54 is oriented at about 90° to the normal position shown in FIG. 6. Limit switch 92 (FIG. 6) is fixed to base assembly 68 and is tripped by carrier 54 when ATM 16 reaches its servicing and maintenance position. Limit switch 94 (FIG. 6) is also fixed to base assembly 68. It is tripped by carrier 54 when ATM 16 returns to its operating position.

Figure 7:
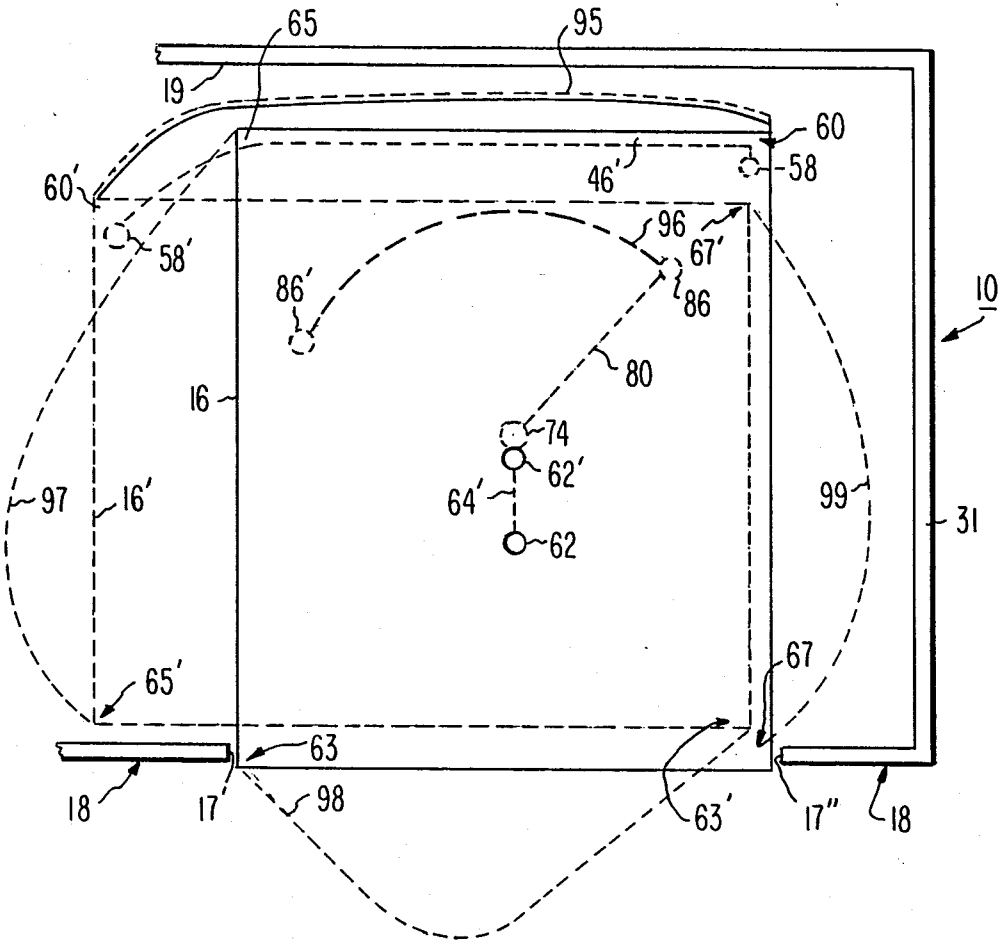
FIG. 7 is a schematic diagram of the paths followed by the corners of the ATM with relation to the enclosure sidewalls of the enclosure of FIG. 3 when turned by the turning apparatus of FIG. 6.

FIG. 7 shows locations of the diagonally-opposite corners 60 and 63 of ATM 16 in its normal operating position and, those corners 60' and 63' in its servicing and maintenance position. Drive bearing 86 transcribes an arc 96 about keyed shaft 74 as it moves from its normal position to its location 86' in the servicing position. Bearing 58 moves along positional track 46 in a path 46' largely parallel to rear sidewall 19 of enclosure 10 to location 58', and right-rear corner 60 of the ATM moves along path 95 generally parallel to path 64'.

Pivot bearing 62 moves along a path 64' determined by pivot track 64 as bearing 62 reciprocates between extreme locations 62 and 62'. Bearings 58, 86, and 62 are positioned generally along a straight line; this alignment tends to minimize the force required to turn carriage 54.

The dash-line path 98 taken by the left front corner 63 of ATM 16 extends from its normal location to its servicing location. The path 98 projects further forward of front sidewall 18, through the access window 17 defined by points 17' and 17" than it would if ATM 16 were rotated about a fixed axis; the latter axis would be at the intersection of the diagonals of the ATM rectangle 16 and with the diagonal as a fixed diameter that produces a circumscribed circle. The width of the enclosure 10 between front and rear walls 18 and 19 using a varying pivot axis as described above is substantially less than that required for rotation about a fixed axis. Similarly the unusable cul-de-sac space between the ATM and end wall 31 (traversed by corner 67 along path 99 to service position 67) is made to be less by turning the ATM about a varying axis as described above than it would be where the ATM is rotated about a fixed axis. Thus, in both respects there is greater efficiency in the use of interior enclosure space.

Figure 8:
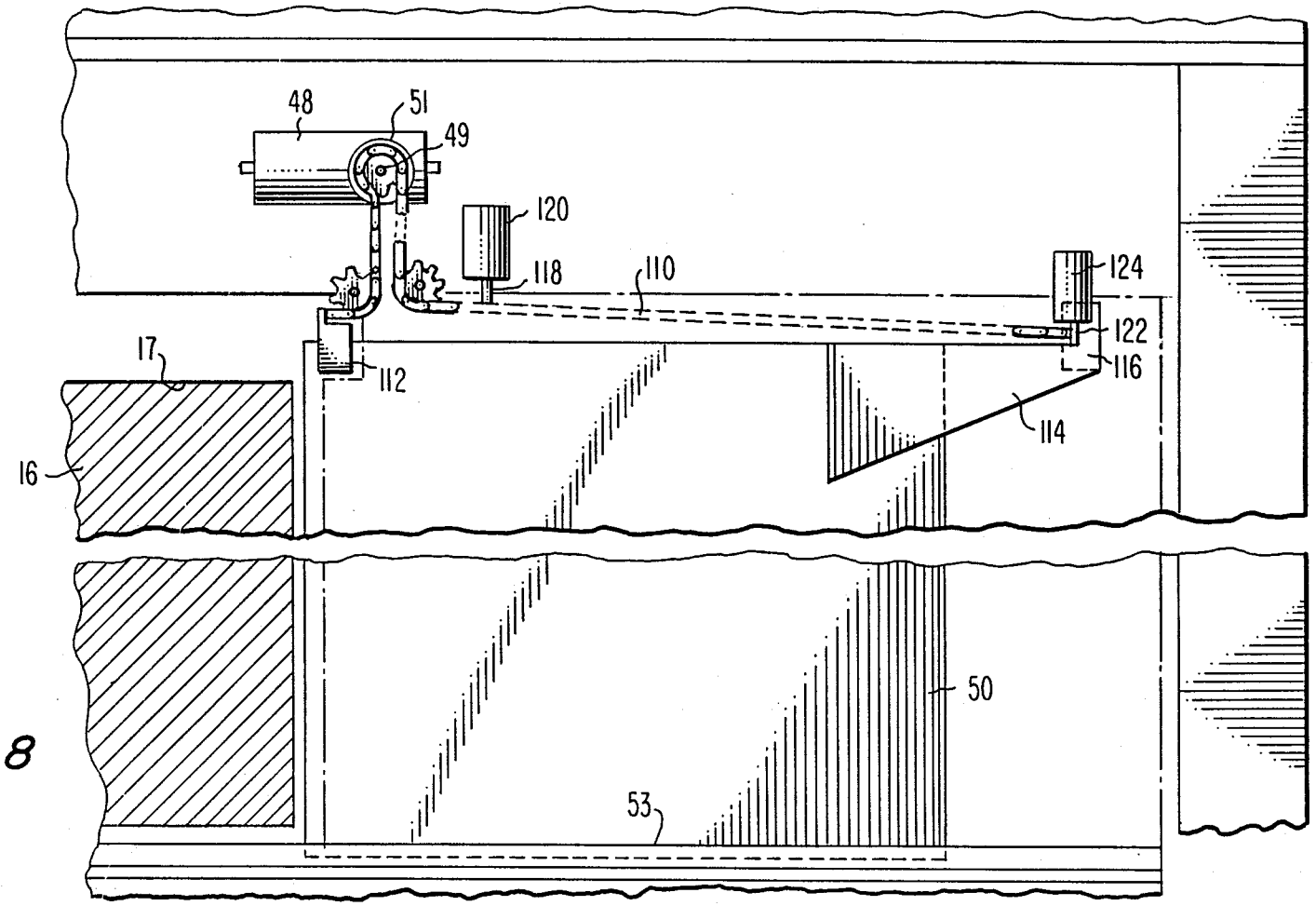
FIG. 8 is an interior view of the front sidewall of the enclosure taken along the line 8—8 of FIG. 3.

The interior of enclosure 10 used by service personnel is shown in FIG. 3 and 8. The security entrance door 30 has a crash bar 200 which releases the door lock when it is pressed forward to allow for rapid, easy exit from enclosure 10. When security door 30 is not fully closed, interlock 206 disconnects the power to a control box 52.

Control box 52 is mounted onto rear sidewall 19. To turn ATM 16 to its servicing and maintenance position a key is inserted into key switch 204, and turned clockwise and held at position-I. Motor 42 is energized to drive turning apparatus 40 and turn ATM 16 counterclockwise. When the turning operation is completed, the forward winding of motor 48 is energized causing closure panel 50 to move forward to close access window 17 in front sidewall 18 of enclosure 10.

After servicing or maintenance is complete, the key is turned reversely and held at position-II which energizes motor 48 for reverse of operation moving closure panel 50 back to its original unshuttered position. Motor 42 is then energized to turn ATM 16 back to its operating position.

A specially slotted hand crank similar to hand crank 91 is also available for shutter motor 48 as back-up if the motor is inoperative or its power is interrupted.

Access window 17 (FIG. 8) is filled with ATM 16 in its operating position, and closure panel 50 is positioned to the side of access window 17. When the key inserted in key switch 204 is turned and held in position-I, the ATM is first turned to its servicing and maintenance position. Shutter motor 48 is then energized, causing shaft 49 mounted to speed reducer 51 to rotate counterclockwise. Chain 210, which is connected at its ends to brackets 212 and 214, is thereby fixed to the end corners of panel 50. As chain 210 is moved to the left, it drives, in turn, closure panel 50 to the left closing access window 17. When closure panel 50 reaches its left-most position, tripping extension 216 (mounted on bracket 214), displaces rod 218 to the left to operate switch 220.

After servicing or maintenance is complete, the key in key switch 204 is turned to position-II. This energizes the reverse winding of motor 48 causing shaft 49 to rotate clockwise (FIG. 8). Chain 210 and, therefore, closure panel 50 are driven to the right, opening access window 17. When closure panel 50 reaches its right-most position, trip extension 216 displaces rod 222 to operate limit switch 224. This cuts off power to the reverse winding of motor 48 and energizes motor 40 for reverse drive to turn the ATM back to its operating position.

As previously discussed, an automatic control system is provided, with a manual back-up, for turning ATM 16 and opening and closing the access window 17 through which the user operates the ATM. FIG. 9 is a schematic diagram showing the elements and interconnections of the control system.

Voltage is applied through interlock switch 206 to terminals of key switch 204. When a key is inserted into key switch 204 and turned counterclockwise and held at position-I, as shown in FIG. 9, movable contact 232 supplies power, via movable contact 236 of carrier limit switch 92, to energize relay 240. Movable contact 242 connects electrical ground to complete the circuit energizing forward winding 245 of motor 42.

Motor 42 applies power to cause turning apparatus 40 to turn the ATM from its operating position to its servicing and maintenance position. Limit switch 92 which is mounted on base assembly 68 (FIG. 6) of turning apparatus 40 is tripped by carrier 54 when the ATM reaches its servicing and maintenance position. This causes movable contact 236 to switch to the opposite contacts, thereby de-energizing relay 240 and removing power from winding 245 to stop the turning of ATM 16.

Moving contact 236 then applies voltage through normally-closed limit switch 220 (FIG. 8) to relay 252. The latter is thus energized and its movable contact 254 applies power to forward winding 257 of shutter motor 48.

Motor 48 causes closure panel 50 to move to the left (FIG. 8) to close access window 17 in front sidewall 18 of enclosure 10. When the closure panel reaches its closed-position, limit switch 220 is tripped de-energizing relay 252 and breaking the ground connection to forward winding 257, which stops motor 48.

The ATM is now in a position for servicing or maintenance by personnel in secure enclosure 10. When the task is complete, the key in control box 52 is turned and held at position-II. Movable contact 232 applies voltage to line 258 and through now-actuated movable contact 260 of limit switch 224. This voltage energizes relay 264 and its movable contact 266 connects ground to reverse winding 268 of motor 48. The latter moves closure panel 50 back to its original position opening the access window. When closure panel 50 reaches its right-most position (FIG. 8) limit switch 224 is tripped. This actuates movable contact 260 to de-energize relay 264 and reverse winding 268 of motor 48, and motion of closure panel 50 stops with the window open.

Movable contact 260 of limit switch 224 now applies voltage to line 270, and via contact 272 of limit switch 94, to energize relay 276. The latter causes movable contact 278 to energize reverse winding 282 of turning motor 42. The latter applies power to turning apparatus 40 to turn the ATM back to its original operating position. When the ATM reaches its operating position, carrier 54 trips limit switch 94 (FIG. 6) and its movable contact 272 de-energizes relay 276 and reverse winding 282. Thereby, motor 42 stops with the ATM at rest in its operating position.

Thus, the key switch 204 enables servicing and maintenance personnel to automatically turn ATM 16 between its operating and servicing and maintenance position and to move closure panel 50. Access window 17 is opened and closed in proper sequence coordinated with the turning of ATM 16.

Thus, in accordance with this invention, a new and improved security enclosure is provided. The ATM is rotated within a compact enclosure of minimal width. Thereby existing drive-through islands can be converted to ATM, and new islands built with efficient land use. The ATM can be serviced quickly by personnel under full security. The only movement required of the enclosure walls for servicing is that of the window shutter. Automatic motor drive under security control is provided for fast operation, and a manual crank is available if power or a motor breaks down. The security enclosure of this invention is particularly adapted for structures using drive-through banking. This security enclosure is also specially adapted for structures intended for walk-up banking; such structures may be self-contained units remote from a bank or otherwise part of a banking building. In addition, the security enclosure may be used for off-premises banking and form part of a market building or form a remote self-contained unit. In each of these situations this invention helps achieve an enclosure having a minimal facility space to be occupied.

The foregoing description of an embodiment of the invention is illustrative and not limiting. Various modifications and other embodiments will be apparent to those skilled in the art. For example, the low-friction bearing pads 66 may be constructed of other materials and, in place of pads, may employ rotatable bearings such as ball bearings when appropriate. Various forms of variable couplings and guides may be used in place of the bearing and track construction. In addition, the bearing and track of each of the guides and variable coupling may be interchanged in relative position.

MODIFIED EMBODIMENT

Figure 10:
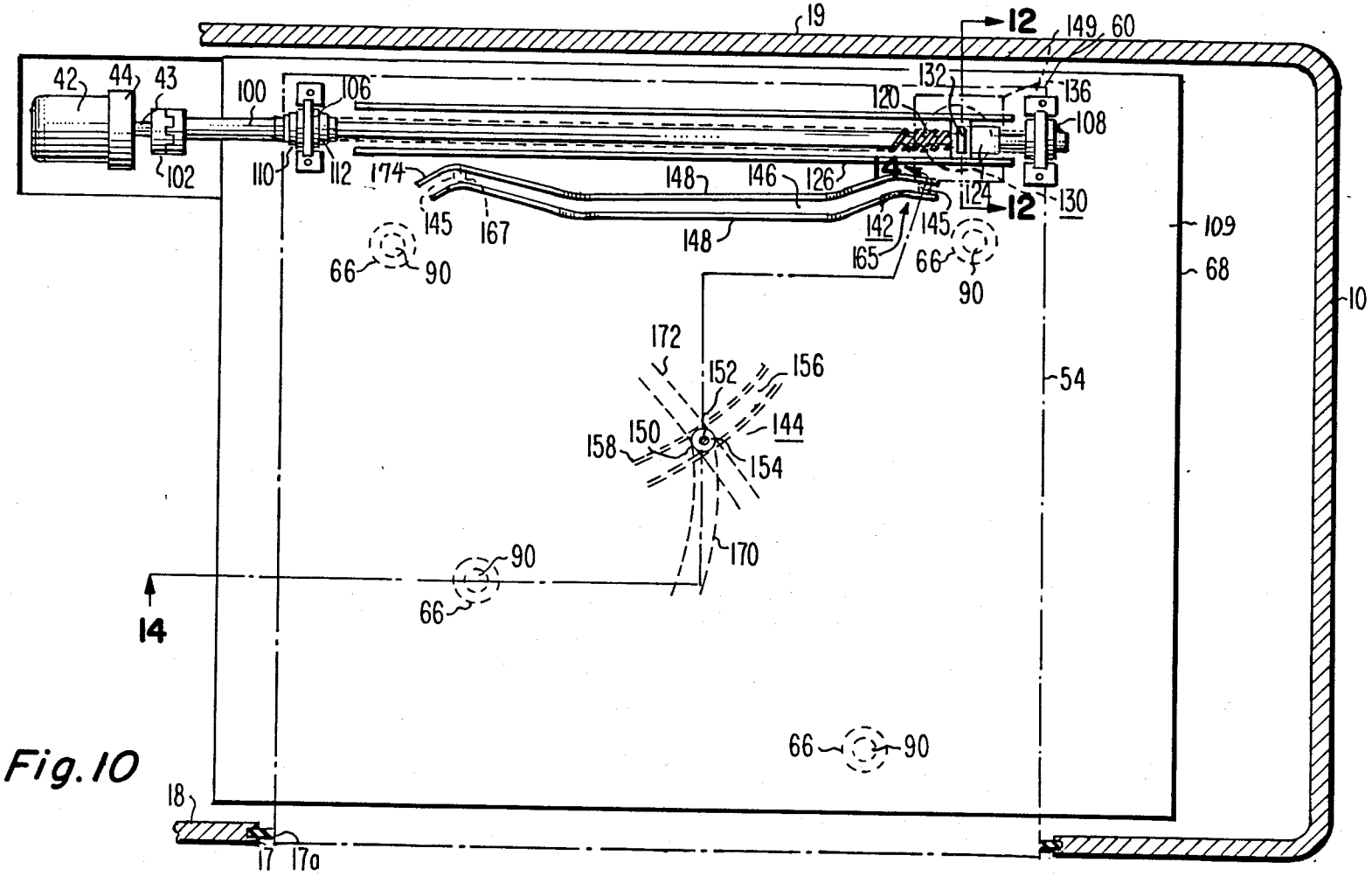
FIG. 10 is a partially schematic plan view of a modified form of turning apparatus for an ATM.

A modified form of turning apparatus for the ATM is shown in FIGS. 10–14 where the same reference numerals as used in FIGS. 1–7 are used to designate corresponding parts of the two embodiments. Referring to FIG. 10, the carrier for the ATM is depicted as a dotted line rectangle 54, and the ATM is in the shape of a cube having the same horizontal cross-section as the rectangle 54 representing the carrier.

The base assembly of the turning apparatus is represented by a solid line rectangle 68 and has a planar upper surface 109 on which the carrier is slidably supported by four legs extending from the underside of the carrier and carrying friction-reducing pads 66, preferably of Teflon, at their lower ends. The Teflon pads rest on the flat upper surface 109 of the base assembly 68 and slide thereon to provide sliding and turning support as the carrier 54 turns, all in essentially the same manner as described with the embodiment of FIGS. 1–7.

For supplying power for turning the carrier 54 on the base assembly 68, an electric motor 42 and a speed reducer 44 having a rotatable output shaft 43 are provided. This output shaft 43 is coupled to a rotatable jackscrew 100 through a jaw-type coupling 102. The jackscrew is rotatably supported at its opposite ends in stationary pillow bearings 106 and 108, which are fixed to the base assembly 68. Conventional thrust bearings 110 and 112 located on axially opposite sides of the left-hand bearing 106 are fixed to the rotatable jackscrew and are adapted to bear on the stationary pillow bearing 106 for transmitting to the pillow bearing axially-directed forces developed in the jackscrew.

The jackscrew 100 contains a helical thread 120 that extends helically along its length. Mounted on the helically threaded portion of the jackscrew is a traveling nut 124 that has internal threads meshing with the jackscrew threads. Extending alongside the jackscrew in straight line paths at opposite sides of the traveling nut are two guides 126. These guides 126 are fixed to the base 68 and prevent the traveling nut 124 from rotating with the jackscrew as the jackscrew is rotated but force the nut to move along the length of the jackscrew in response to jackscrew rotation. In summary, as the jackscrew 100 is rotated, the traveling nut 124 moves along the length of the jackscrew and the guides, following a linear path between the guides 126. Self-lubricating coatings 127 (FIG. 12) of Teflon at opposite sides of the traveling nut reduce friction between the nut and the guides as the nut moves along the guides.

Figure 12:
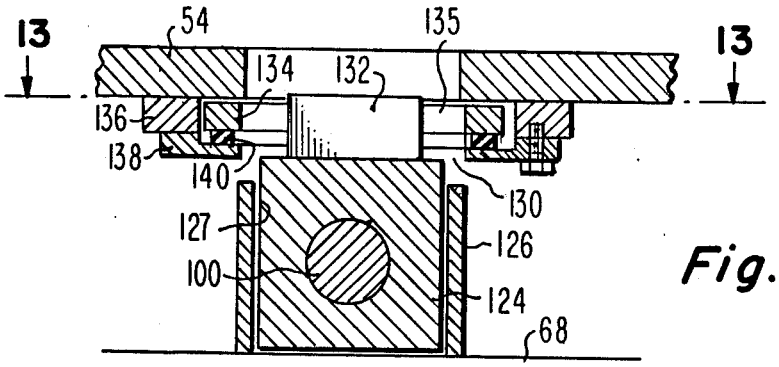
FIG. 12 is an enlarged sectional view along the line 12—12 of FIG. 10.
Figure 13:
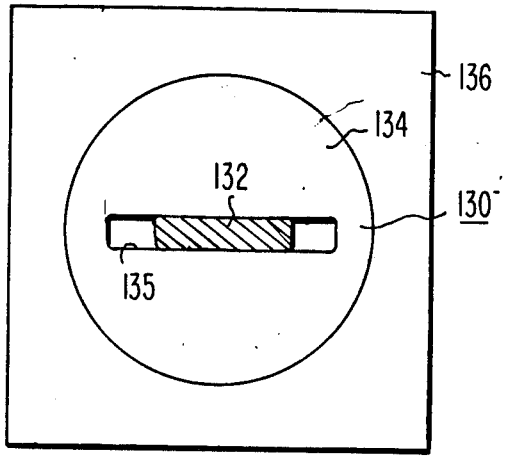
FIG. 13 is a view taken along the line 13—13 of FIG. 12.
Figure 14:
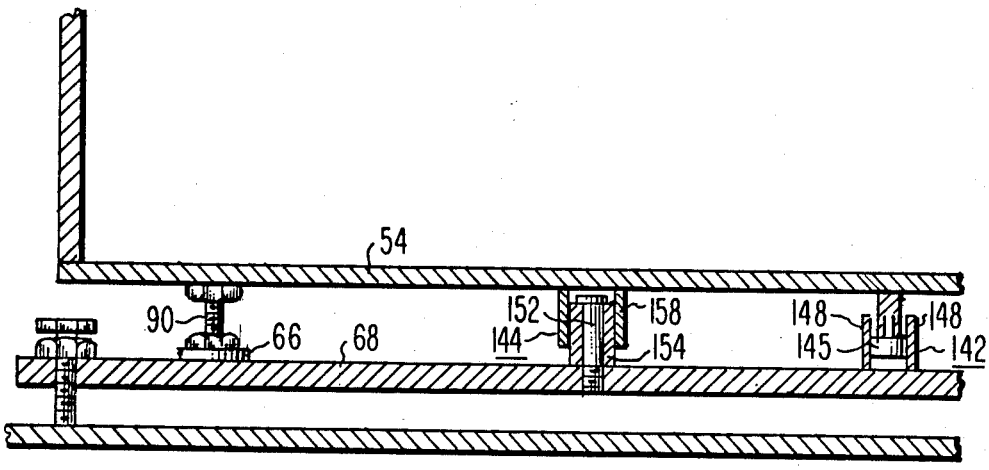
FIG. 14 is a partially schematic sectional view taken along the line 14—14 of FIG. 10.

For coupling the traveling nut 124 to the carrier 54, there is provided a slotted pivot joint 130, best shown in enlarged views in FIGS. 12 and 13. This slotted pivot joint comprises a projecting arm 132 rigid with the traveling nut and projecting laterally therefrom. As seen in FIG. 13, this arm 132 has a generally rectangular cross section with rounded ends. Receiving this arm 132 is a slotted circular metallic disc 134 carried by the carrier 54 and freely rotatable with respect to the carrier about a vertical axis. A transversely-extending slot 135 in disc 134 freely receives the arm 132 on the traveling nut and allows the circular disc to shift transversely of the arm 132 as carrier-turning forces are transmitted from the nut to the carrier 54 via the slotted pivot joint.

Referring to FIG. 12, the circular disc 134 is held in a position beneath the carrier 54 by means of bearing plate 136 fixed to the carrier and having a circular opening for freely receiving the disc. For supporting the rotatable disc 134, an annular cap 138 is secured to the bearing plate 136 at its lower side and carries a Teflon disc 140 on which the circular metallic disc 134 rests. The Teflon disc 140 is of the same diameter and shape, when viewed in a horizontal plan view, as the disc 134. Accordingly, the Teflon disc provides an anti-friction surface on which the metallic disc is supported and is freely rotatable. When the traveling nut 124 is moved along the jackscrew, the slotted pivot joint 130 transmits turning force to the carrier 54 in a manner soon to be described.

For controlling the path of movement of the carrier 54 on the upper surface of the base 68 when the carrier is turned, there are provided two cam connections 142 and 144 between the carrier and the base. Cam connection 142 comprises a vertically-extending follower 145 in the form of a pin fixed to the carrier 54 and projecting downwardly therefrom in a location adjacent to the rear right-hand corner 60 of the carrier. This follower 145 is received in a camming channel 146 provided between a pair of uniformly spaced guides 148 fixed to the upper surface 109 of the base 68. As will soon appear more clearly, when the carrier is turned about a vertical axis of rotation (soon to be described), the follower moves within the camming channel 146 via a path determined by the shape of guides 148, thereby controlling the path of movement of the rear right-hand corner 60 of the carrier 54 during such turning of the carrier.

The second cam connection 144 comprises a trunnion 150 fixed to the base plate 68 in a central location. The trunnion comprises a central supporting pin 152 fixed to the base plate and a sleeve bearing 154 encircling the pin 152 and freely rotatable thereon. The trunnion 150 is received in a camming channel 156 defined by a pair of uniformly-spaced camming guides 158 fixed to the carrier 54 and projecting downwardly therefrom. As will soon appear more clearly, as the carrier 54 is turned about the aforesaid vertical axis of rotation (soon to be described); the central region of the carrier moves along a path determined by the shape of the guides 158.

Figure 11:
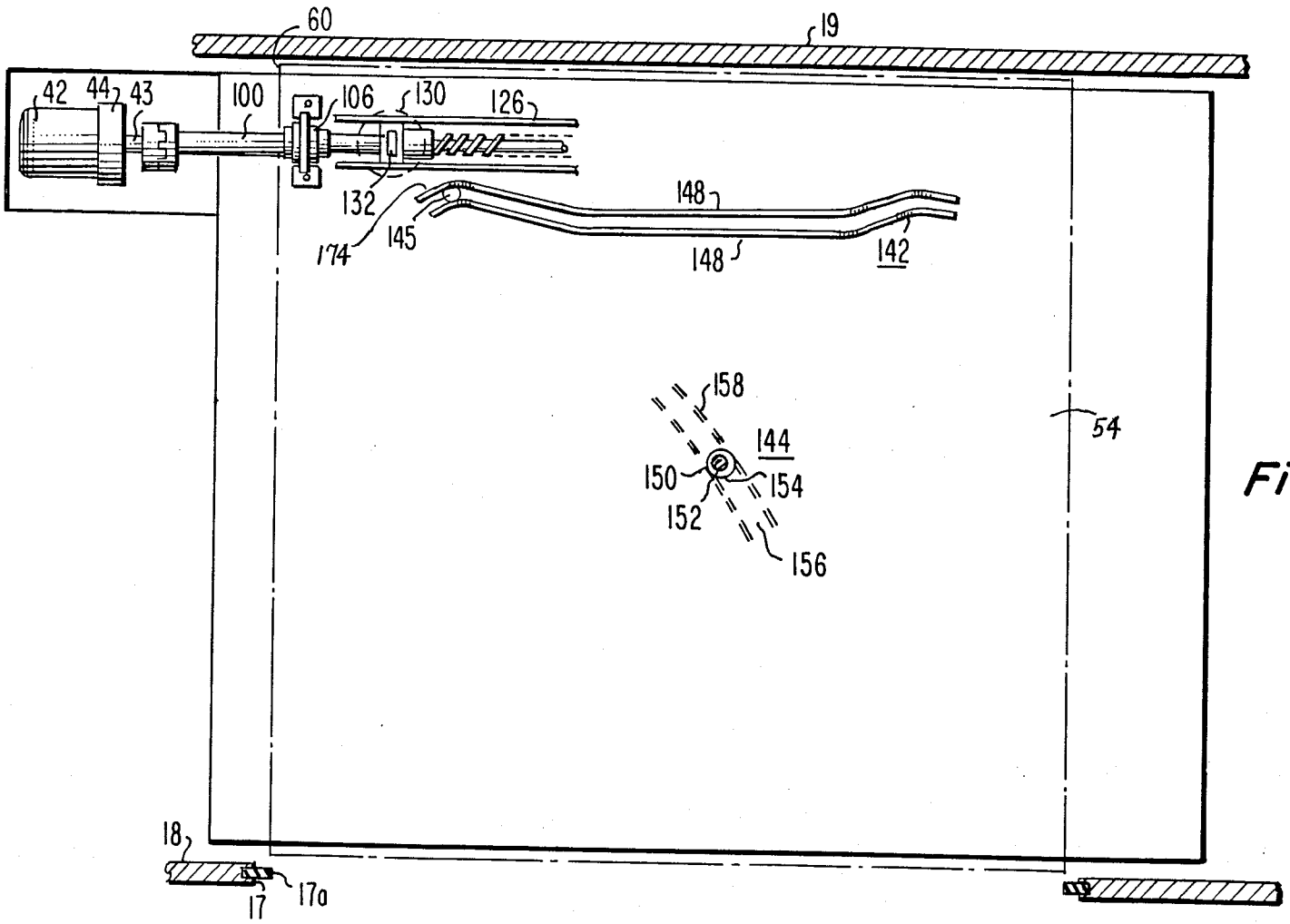
FIG. 11 is a plan view similar to FIG. 10 except showing the parts in their positions occupied when the ATM is about to enter its service-access position.

Moving the ATM from Its Normal-Operating Position to Its Service-Access Position When it is desired to turn the ATM counterclockwise from its normal operating position of FIG. 10 to its service-access position of FIG. 11, the motor 42 is energized to drive the jackscrew 100 in a direction that causes the traveling nut 124 to move to the left along the jackscrew. This motion of the traveling nut is transmitted to the carrier 54 via the slotted pivot joint 130. More specifically, the arm 132 on the traveling nut applies carrier-turning force to the carrier via the rotatable disc 134. As the carrier turns in response to this force, the disc 134 rotates a small amount within bearing plate 136 and the arm 132 concurrently shifts transversely with respect to the disc as permitted by the slot 135 in disc 134.

Initial motion of the traveling nut 124 to the left from its position of FIG. 10 moves the carrier 54 a short distance rearwardly so as to withdraw the ATM from window 17 in the front sidewall 18 and enable the gasket 17*a* to be cleared when the ATM is next turned. This rearward motion of the ATM is produced by the guides 148 in cam connection 142. These guides 148 at their right-hand end each have a short section 165 sloping slightly toward the rear of the carrier, and thus the guides coact with the follower 145 to force the carrier a short distance rearwardly in response to initial leftward motion of traveling nut 124.

Continued motion of the nut 124 to the left causes the carrier 54 to rotate counterclockwise about a vertical axis (soon to be described) that moves transversely of itself and with respect to both the enclosure 10 and the carrier 54 as the carrier is rotated. The rear right-hand corner 60 of the carrier 54 follows a path substantially parallel to the back sidewall 19 of the enclosure as determined by the follower 145 moving in the camming channel 146 while the central region of the carrier follows a path determined by the guides 158 moving on the stationary trunnion 150.

Figure 10A:
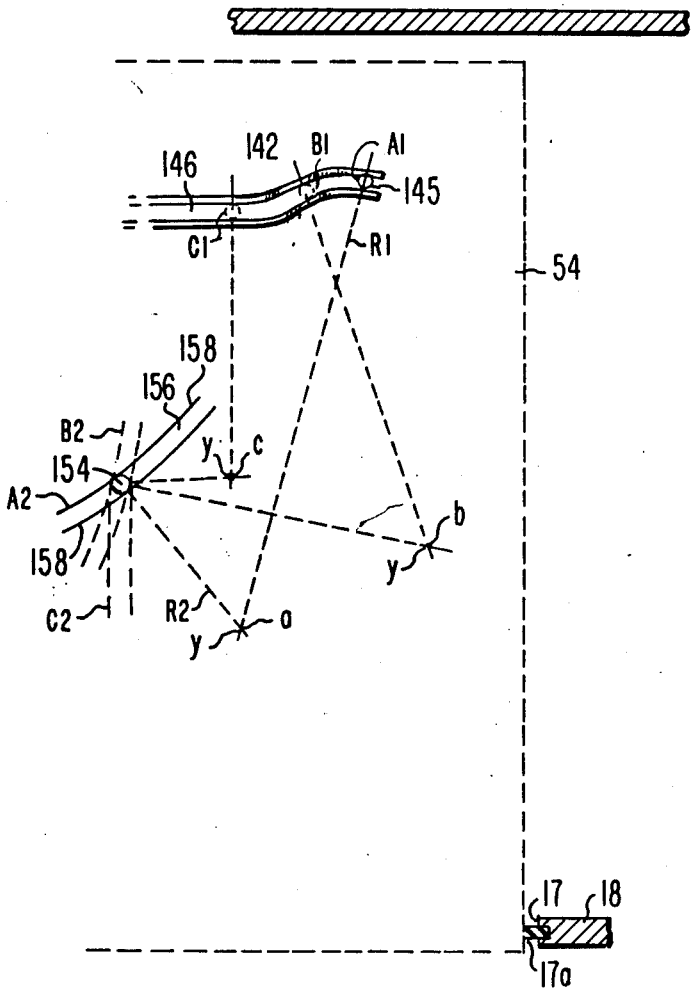
FIG. 10*a* is a schematic plan view of a portion of the turning apparatus of FIG. 10 showing a series of positions through which the depicted parts move during a portion of the turning motion.

Referring to FIG. 10*a*, the axis of rotation for the carrier 54 is a moving vertically-extending axis Y having instantaneous locations that are determined by the instantaneous positions of the follower 145 within the camming channel 146 and of the trunnion 154 within the camming channel 156. At any given instant, the location of this axis Y is at the intersection of two reference lines, R1 and R2, one such reference line R1 extending perpendicular to the active surfaces of the guides 142 at the then-existing location of follower 145, and the other such reference line R2 extending perpendicular to the active surfaces of camming guides 158 at the then-existing location of trunnion 154. FIG. 10*a* shows how this axis of rotation moves as the follower 145 moves from location A1 through locations B1 and C1. More specifically, when the follower 145 is in location A1, the camming guides 158 are in location A2, and the above-described reference lines intersect at point a, thus locating axis Y at point a at this instant. When the follower 145 is in location B1, the camming guides 158 are in location B2, and the reference lines intersect at point b. Similarly, when follower 145 is at C1, the camming guides are in location C2, and the reference lines intersect at point c. Thus, axis Y moves from point a through points b and c during this movement of the follower 145.

The operation of the embodiment of FIGS. 1–7 can be analyzed in essentially the same way as the FIGS. 10–14 embodiment has been analyzed in the immediately-preceding paragraph. In the FIGS. 1–7 embodiment, the axis of rotation for the carrier 54 at any given instant is likewise at the intersection of reference lines, corresponding to R1 and R2 of FIG. 10*a*, extending perpendicular to the active surfaces of the camming guides 46 and 64 at the then-existing locations of the followers 58 and 62, respectively.

When the carrier 54 has turned counterclockwise about its vertical axis of rotation Y through approximately 90°, the follower 145 has traversed almost the entire length of the camming channel 146 and has reached its dotted line position 167 of FIG. 10. During this interval, the guides 158 of the cam connection 144 have moved through an intermediate position shown by dotted lines 170 into an advanced position shown by dotted lines 172. The combined effect of the two cam connections 142 and 144 has been during approximately the first 45° of turning, to move the central region of the carrier 54 toward the front sidewall 18 of the enclosure and during approximately the last 45° of turning, to move this central region toward the back sidewall 19.

After the follower 145 has reached its position shown at 167 in FIGS. 10 and 11, the traveling nut is moved a short distance further to the left. Referring to FIG. 11, this causes the carrier 54 to move forwardly of the enclosure, causing a side portion of the ATM to enter the window 17 originally occupied by the front portion of the ATM, with the gasket 17*a* providing a seal with respect to the side portion. This forward motion of the ATM is produced by a forwardly inclined left-hand end portion 174 of the guides 148 acting on cam follower 145 to press the cam follower and the carrier 54 forward.

It is to be noted that during the above-described turning of the carrier following the initial motion that withdrew the ATM from the window 17, the right-hand rear corner 60 of the carrier followed a path that was substantially parallel to the back sidewall 19 of the enclosure 10. This was made possible by the fact that the axis of rotation of the carrier was bodily moved during such turning, as illustrated in FIG. 10*a*. Such movement of the axis of rotation was effected by the follower 145 moving in the camming channel 146 of one cam connection 142 and by the shifting of guides 158 with respect to the trunnion 150 of the other cam connection 144.

It will be apparent that in both illustrated embodiments of this invention, the ATM projects through the window of the enclosure during turning while its rear corner 60 moves generally parallel to the rear wall (19) of the enclosure during most of the turning motion. This relationship enables me in both embodiments to accomplish the desired turning in an enclosure of near-minimum width, considerably smaller than the diagonal dimension of the ATM. In the embodiment of FIGS. 10–14, I am able to reduce the enclosure width even more than I have with the embodiment of FIGS. 1–9, thus making it possible in the embodiment of FIGS. 10–14 to utilize for an ATM of conventional size an enclosure of a width of only 32 inches, which enclosure easily fits on an island 3 feet in width.

It is to be further noted that no separate door is required to cover the access window 17 for the ATM when the ATM is in its service-access position. This is because the side portion of the ATM, when the ATM is in its service-access position, fills such window. As explained above, final movement of the traveling nut 124 drives the ATM forwardly into its final position where the ATM fills the window. With the ATM in this position, the ATM sidewall in effect acts as a closure, requiring no separate closure for the window.

Moving the ATM from Its Service-Access to Its Normal Operating Position

For returning the ATM from its above-described service-access position to its normal operating position of FIG. 10, the jackscrew 100 is rotated in a direction to return the traveling nut to the right from its above-described final position, through its position of FIG. 11, to its position of FIG. 10. Such motion of the traveling nut to the right first moves the ATM backwardly a short distance into its position of FIG. 11, withdrawing it from its access window 17. Continued motion of the traveling nut to the right turns the carrier 54 in a clockwise direction about its vertical axis of rotation, causing the follower 145 to move to the right in camming channel 146 to thereby retrace its original path. Concurrently with such movement of the follower 145, the guides 158 move in a reverse direction through the dotted line positions 172 and 170 depicted in FIG. 10, finally returning to the dotted line position of FIG. 10. The final stage of such rightward movement of the traveling nut 124 presses the ATM forward into the access window 17, where it is shown in FIG. 10. This final forward motion of the ATM is produced by the follower 145 moving between sloping sections 165 at the right-hand end of the camming channel 146.

GENERAL DISCUSSION OF MODIFIED EMBODIMENT

Although FIGS. 10–13, for simplicity, show the jackscrew and traveling nut as having simple helical threads; in a commercial form of the invention, I have utilized a jackscrew and nut of the ball-screw and ball-nut type employing recirculating rolling balls at the screw and nut interface. This type of ball screw and ball nut is commercially available and is characterized by especially low friction and high efficiency in transmitting power between the screw and nut. Using such a ball screw and nut, I am able to reduce the power rating of the motor 42 from one-sixth to one-eighth horsepower as compared to the design of FIGS. 1–7.

Another advantage that the embodiment of FIGS. 10–14 has over that of FIGS. 1–7 is that the embodiment of FIGS. 10–14 uses only two cam tracks instead of the three present in FIGS. 1–7. This facilitates manufacture of the base and carrier assembly, since it is considerably easier to precisely align two cam tracks with respect to each other than three.

It is to be noted that in the embodiment of FIGS. 10–14, the trunnion 150 of cam connection 144 is located on the stationary base and the mating tracks 158 on the movable carrier 54. If the tracks had instead been on the stationary base and the trunnion on the carrier, it would have been necessary to make the tracks of a much more complicated and space-consuming form. This would have provided much less free space on the base 68 for the supporting feet 66, 90 to move around on during turning of the ATM.

It will be apparent to those skilled in the art from the foregoing description of my invention that various improvements and modifications can be made in it without departing from the true scope of the invention. Accordingly, it is my intention to encompass within the scope of the appended claims the true limits and spirit of my invention.

I claim:

1. Security apparatus for a transaction-processing machine that has an operating interface on one surface and a service-access interface on another surface, comprising:

(i) a walled enclosure having a window in one of its walls, (ii) means for mounting said transaction-processing machine within said enclosure in a normal-operating position where said operating interface is located adjacent said window and said service-access interface is located adjacent a second wall of said enclosure, said means for mounting comprising:

(a) means for turning said machine about a vertical axis to a position where said service-access interface is transversely disposed relative to said second wall and is accessible for entry from inside said enclosure, (b) means for causing said vertical axis to move with respect to said enclosure when said machine is turned about said vertical axis, and (c) a movable carrier for said machine, a base, and means for supporting said carrier on said base for turning movement thereon, (d) said means for turning comprising a rotatable jackscrew mounted on said base, a traveling nut on said jackscrew that moves along the length of said jackscrew when the jackscrew is rotated, and coupling means between said traveling nut and said carrier for transmitting carrier-turning force from said traveling nut to said carrier, said coupling means comprising a pivot joint that is constructed to allow said carrier to turn about said vertical axis and a pin and slot connection that is constructed to allow said vertical axis to move with respect to said enclosure as said traveling nut is moved along the jackscrew.

2. The apparatus of claim 1 in which:

(a) said machine has a corner that moves adjacent said second enclosure wall when the machine is turned between its normal-operating and its service-access positions, and (b) said mounting means further comprises two cam connections between said base and said carrier, one of said cam connections forcing said corner of the transaction-processing machine to move along a path, most of which is substantially parallel to said second wall of the enclosure when the machine is turned from its normal-operating position to its service-access position, the other cam connection acting during turning of the machine to force said vertical axis to shift along a path that permits said corner to move via said substantially parallel path during turning of the machine.

3. The apparatus of claim 2 in which:

(a) said first cam connection comprises: (i) spaced guides fixed to said base and defining a camming channel having a major portion substantially parallel to said second enclosure wall and (ii) a follower fixed to said carrier and movable, responsive to machine-turning, within said camming channel along a path determined by the shape of said camming channel, and (b) said second cam connection comprises (i) guides fixed to said carrier and defining a second camming channel and (ii) a follower fixed to said base and received within said second camming channel.

4. The apparatus of claim 2 in which said first cam connection comprises: (i) spaced guides fixed to said base and defining a camming channel having a major portion substantially parallel to said second enclosure wall and (ii) a follower fixed to said carrier and movable, responsive to machine-turning, within said camming channel along a path determined by the shape of said camming channel.

5. The apparatus of claim 1 in which:

(a) said machine has a corner that moves adjacent said second enclosure wall when the machine is turned between its normal-operating position and its service-access position, and (b) said mounting means further comprises a cam connection between said base and said carrier that causes said corner of the transaction-processing machine to move along a path most of which is substantially parallel to said second wall of the enclosure when the machine is turned from its normal-operating position to its service-access position.

6. Security apparatus for a transaction-processing machine that has an operating interface on one surface and a service-access interface on another surface, comprising:

(i) a walled enclosure having a window in one of its walls, (ii) means for mounting said transaction processing machine within said enclosure in a normal-operating position where said operating interface is located adjacent said window and said service-access interface is located adjacent a second wall of said enclosure, said means for mounting comprising:

(a) means for turning said machine about a vertical axis to a position where said service-access interface is transversely disposed relative to said second wall and is accessible for entry from inside said enclosures, (b) means for causing said vertical axis to move with respect to said enclosure when said machine is turned about said vertical axis, and (c) a movable carrier for said machine, a base, and means for supporting said carrier on said base for turning movement thereon, (d) said means for turning comprising cam means between said base and said carrier that: (i) acts to withdraw said operating interface of the machine from said window prior to turning of said machine about said vertical axis from said normal-operating to said service-access positions and (ii) acts to position a side portion of said machine within said window after the machine has been turned to substantially said service-access position.

7. The apparatus of claim 6 in which gasketing means is provided about the inner edge region of said window: (i) to provide a seal between said window and the portion of said machine at said operating interface when the machine is in its normal-operating position and also (ii) to provide a seal with said side portion of the machine when said side portion has been moved into said window when the machine is in its service-access position.

8. The apparatus of claim 1 in which said means for turning also comprises cam means between said base and said carrier that (i) acts to withdraw said operating interface of the machine from said window prior to turning of said machine about said vertical axis from said normal-operating to said service-access positions and (ii) acts to position a side portion of said machine within said window after the machine has been turned to substantially said service-access position.

9. The apparatus of claim 8 in which gasketing means is provided about the inner edge region of said window (i) to provide a seal between said window and the portion of said machine at said operating interface when the machine is in its normal-operating position and also (ii) to provide a seal with said side portion of the machine when said side portion has been moved into said window when the machine is in its service-access position.

10. The apparatus of claim 1 in which said machine has a side portion that is positioned to effectively close off said window when the machine has been moved by jackscrew operation into its position of service-access.

11. In security apparatus for a transaction-processing machine that has an operating interface on one surface and a service-access interface on another surface, (a) a walled enclosure having a window in one of its walls, (b) means for mounting said transaction-processing machine within said enclosure in a normal-operating position where said operating interface is located adjacent said window and said service-access interface is located adjacent a second wall of said enclosure, (c) said means for mounting including means for turning said machine from its normal-operating position to a position where said service-access interface is transversely disposed relative to said second wall and is accessible for entry from inside said enclosure, (d) said means for mounting further comprising a movable carrier for said machine, a base, and means for supporting said carrier on said base for turning movement thereon, (e) said machine having a corner that moves adjacent said second enclosure wall when the machine is turned between its normal-operating and it service-access positions, and (f) said mounting means also comprising two spaced-apart cam connections between said base and said carrier, one of said cam connections forcing said corner of the transaction-processing machine to move along a path, most of which is substantially parallel to said second wall of the enclosure, when the machine is turned from its normal-operating position to its service-access position, and the other cam connection acting during turning of the machine to force shifting of the machine along a path that permits said corner to move via said substantially parallel path during turning of the machine.

12. The apparatus of claim 11 in which said first cam connection comprises: (i) spaced guides fixed to said base and defining a camming channel having a major portion substantially parallel to said second enclosure wall and (ii) a follower fixed to said carrier and movable, responsive to machine-turning, within said camming channel along a path determined by the shape of said camming channel.

13. The apparatus of claim 11 in which said cam connections: (i) act to withdraw said operating interface of the machine from said window prior to turning of said machine from said normal-operating to said service-access positions and (ii) act to position a side portion of said machine within said window after the machine has been turned to substantially said service-access position.

14. The apparatus of claim 13 in which gasketing means is provided about the inner edge region of said window: (i) to provide a seal between said window and the portion of said machine at said operating interface when the machine is in its normal-operating position and also (ii) to provide a seal with said side portion of the machine when said side portion has been moved into said window when the machine is in its service-access position.

* * * * *